US006305578B1

(12) United States Patent
Hildebrandt et al.

(10) Patent No.: US 6,305,578 B1
(45) Date of Patent: Oct. 23, 2001

(54) DEVICE FOR MIXING, FOAMING AND DISPENSING LIQUIDS FROM SEPARATE COMPRESSED-GAS CONTAINERS

(75) Inventors: Bodo Hildebrandt, Riedstadt; Johannes Burghaus, Gross-Umstadt; Heiko Eberhardt, Oberursel; Udo Kohn, Dieburg; Joerg Mayer, Darmstadt-Eberstadt, all of (DE)

(73) Assignee: Wella Aktiengesellshaft, Darmstadt (DE)

( * ) Notice: Subject to any disclaimer, the term of this patent is extended or adjusted under 35 U.S.C. 154(b) by 0 days.

(21) Appl. No.: 09/673,932

(22) PCT Filed: Feb. 28, 2000

(86) PCT No.: PCT/EP00/01655

§ 371 Date: Dec. 18, 2000

§ 102(e) Date: Dec. 18, 2000

(87) PCT Pub. No.: WO00/50163

PCT Pub. Date: Aug. 31, 2000

(30) Foreign Application Priority Data

Feb. 26, 1999 (DE) ..... 199 08 368

(51) Int. Cl.[7] ..... B67D 5/52
(52) U.S. Cl. ..... 222/135; 222/145.5; 239/306
(58) Field of Search ..... 222/185, 136, 222/137, 145.5, 145.6; 239/306, 308, 318, 328

(56) References Cited

U.S. PATENT DOCUMENTS 3,236,457 * 2/1966 Kennedy et al. ..... 239/306
3,303,970 * 2/1967 Breslau et al. ..... 239/306
3,451,593 6/1969 Dillarstone .
3,825,159 7/1974 Laauwe .
5,169,029 12/1992 Behar .
5,270,014 12/1993 Bauer .
5,330,724 7/1994 Bauman .
5,874,024 2/1999 Knaus .

FOREIGN PATENT DOCUMENTS 37 29 491 A 3/1988 (DE) .
1 302 577 A 1/1973 (GB) .
92 14595 A 9/1992 (WO) .

* cited by examiner

*Primary Examiner*—Philippe Derakshani
*Assistant Examiner*—Thach H Bui
(74) *Attorney, Agent, or Firm*—Michael J. Striker

(57) ABSTRACT

A compressed gas container apparatus having at least two compressed gas containers disposed side by side, each for one foamable liquid product which contains a liquidified propellant gas, wherein both compressed gas containers are each provided with a valve; both valves are actuatable in common by a top fitting, and each valve is provided through the top fitting with a connecting conduit; the connecting conduits discharge into a mixing chamber and an expansion conduit adjoins the mixing chamber and on its end has a foam dispensing opening; wherein the connecting conduits and the mixing chamber have such small cross-sectional areas that when a product is dispensed, the products flowing through the connecting conduits and the mixing chamber remain in a liquid phase.

20 Claims, 16 Drawing Sheets

Figure 1:
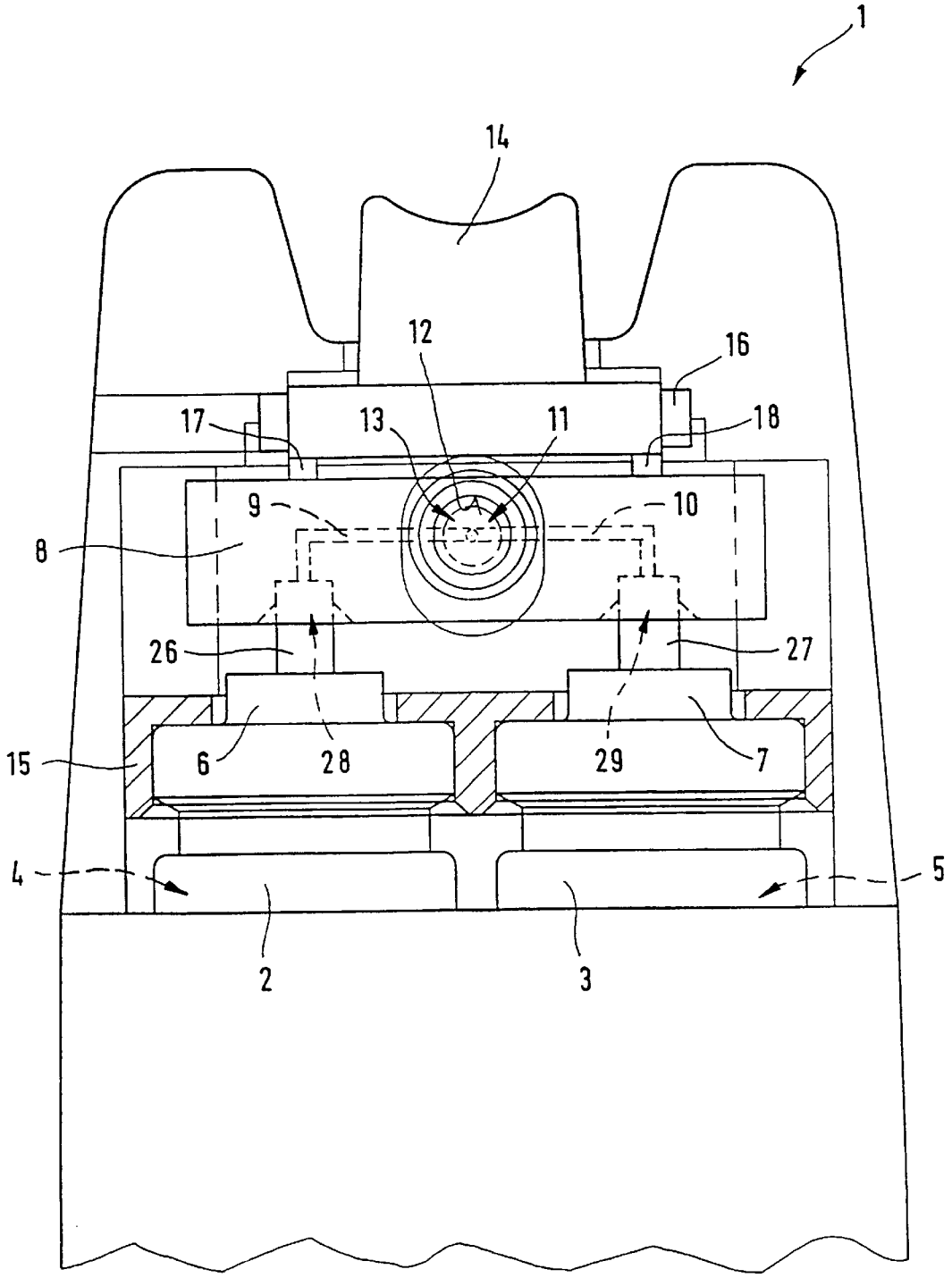

DEVICE FOR MIXING, FOAMING AND DISPENSING LIQUIDS FROM SEPARATE COMPRESSED-GAS CONTAINERS

The invention relates to a compressed gas container apparatus.

From German Patent Disclosure DE 37 29 491 Al which defines this generic type, a compressed gas container apparatus is known, having at least two compressed gas containers, disposed side by side, each for one foamable liquid product which contains a liquidfied propellant gas, wherein both compressed gas containers are each provided with a valve. Both valves are actuatable in common by a top fitting, and each valve is provided through the top fitting with a connecting conduit. The connecting conduits discharge into a mixing chamber, and an expansion conduit adjoins the mixing chamber and on its end has a foam dispensing opening.

This apparatus has the disadvantage that the dispensed foam comprising the two products is not optimally (homogeneously) mixed. This is because the products even as they emerge from the product dispensing valves foam up and are discharged in unmixed foam form into the mixing conduit through the connecting conduits. In the mixing chamber as well, the two foam components flow more or less side by side, and a passive mixing device is therefore adjoined to the mixing chamber in order to achieve further, but still inadequate, mixing of the two foam components.

The object of the invention is to create a compressed gas container apparatus of this same generic type, with which by simple provisions, substantially improved homogeneity of the two products in the dispensed foam is achieved.

This object is attained in accordance with the body of claim 1. Further advantageous features of the invention are recited in the dependent claims.

Because the connecting conduits and the mixing chamber have such small cross-sectional areas that when a product is dispensed, the products flowing through the connecting conduits and the mixing chamber remain in a liquid phase, optimal mixing (homogeneity) of the two liquid products in the mixing chamber is achieved, and as a result, after the expansion of the mixed liquid, an optimally mixed foam results. Accordingly it is not the foam that is mixed but instead, mixing is done extremely effectively in the still-liquid phase of the products, before foaming occurs.

A further improvement in the mixing of the two liquid products is attained in that connecting conduits discharging into the mixing chamber are oriented at an angle of approximately 180° from one another.

It is advantageous if the connecting conduits have a diameter of approximately 0.6 mm and the mixing chamber has a diameter of from 0.4 to 1.2 mm—preferably approximately 0.6 mm—and as a result the products then still remain in a liquid phase and as a result are optimally mixed. This is important and advantageous in terms of the fact that products that have already foamed up can be made to mix only poorly. Optimal mixing of both products in foam form is especially important for example in foam products for hair treatment, especially a foam dye composed of one peroxide component and one colorant component, since the quality of the dye product depends on the quality of the mixed products.

By means of an impact part disposed oriented toward the mixing chamber disposed in the beginning region of the expansion conduit, an additional mixing of the mixed products is achieved.

Depending on the embodiment of the impact parts (as a disk, concave, and/or with a relatively raw surface), the mixing process of the liquids can be still further optimized.

A dam chamber or an annular chamber, each of which interrupts a connecting conduit, has the function of a retention filter for solid product components (solid particles) that have formed, for instance from crystallization.

Because the mixing chamber with mixing chamber orifices is provided as an insert part into the top fitting, there is the advantage of a simple tool for producing the top fitting and the advantage of an adaptation of the cross section of the mixing chamber orifices and the mixing chamber, so that a targeted adaptation to various product viscosities and various propellant gas pressures can selectively be made.

In a further embodiment of the insert part, it is advantageously provided that the dam chamber (annular chamber) is formed by the insert part, and as a result, in addition, the required dam chamber volume can be predetermined.

The invention will be described in further detail in terms of four exemplary embodiments.

Figure 2:
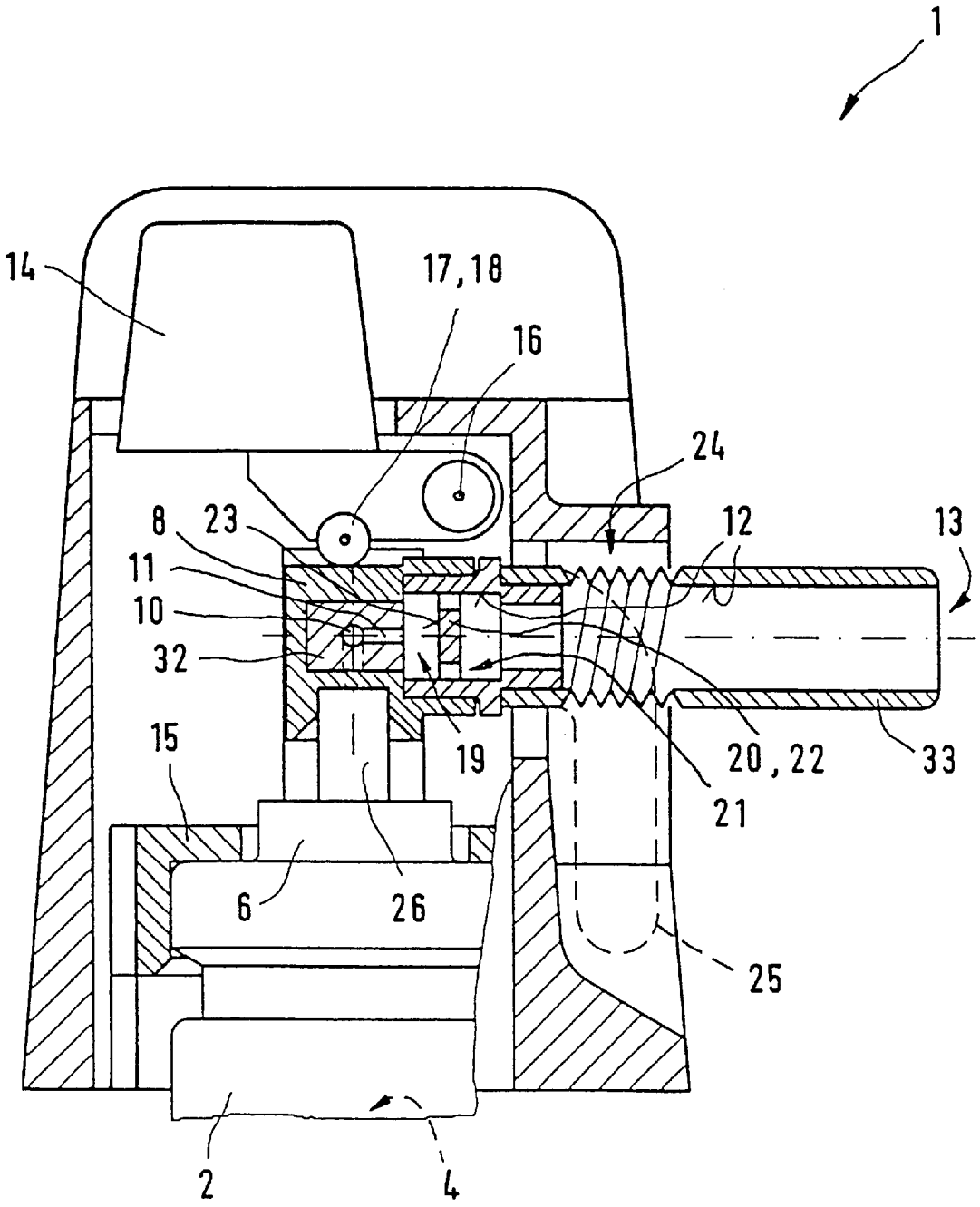
Figure 3:
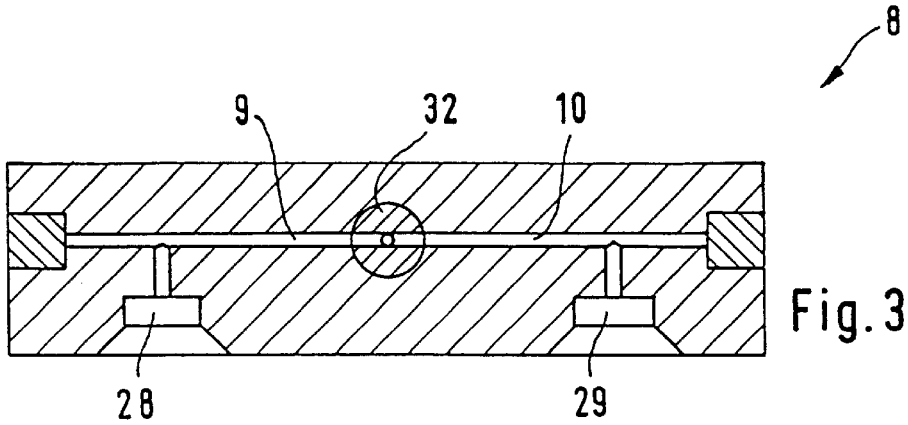
Figure 4:
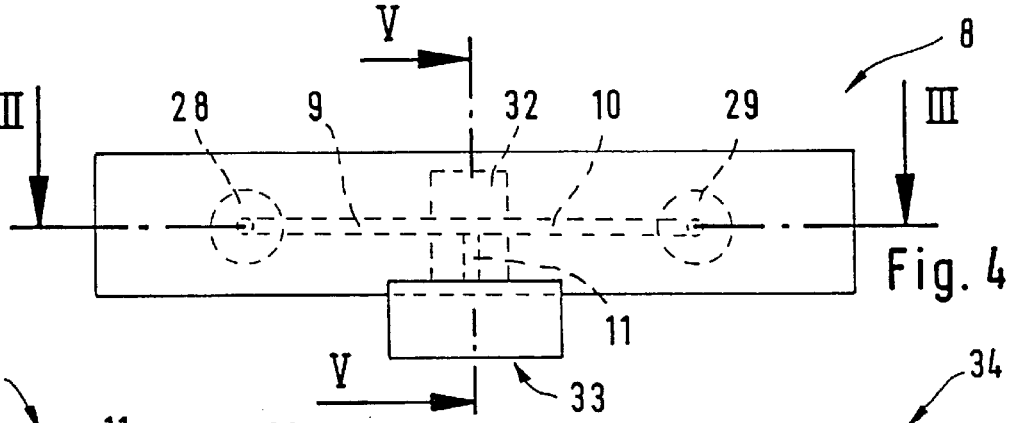
Figure 5:
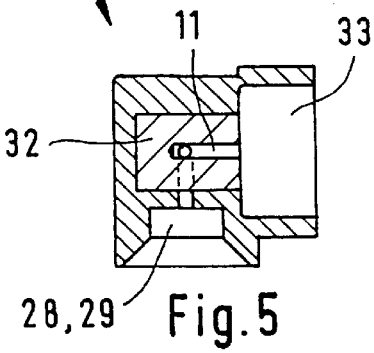
Figure 6:
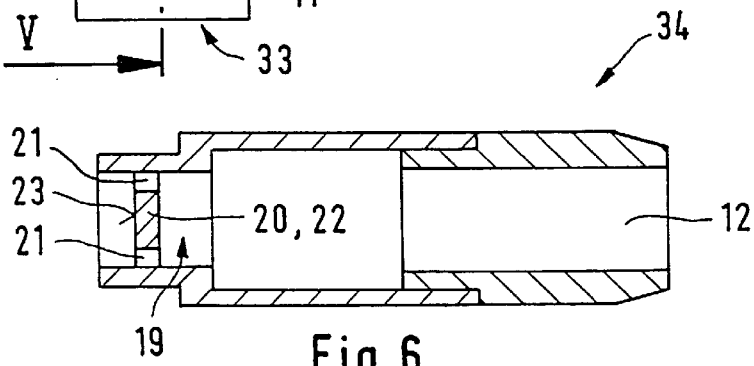
Figure 7:
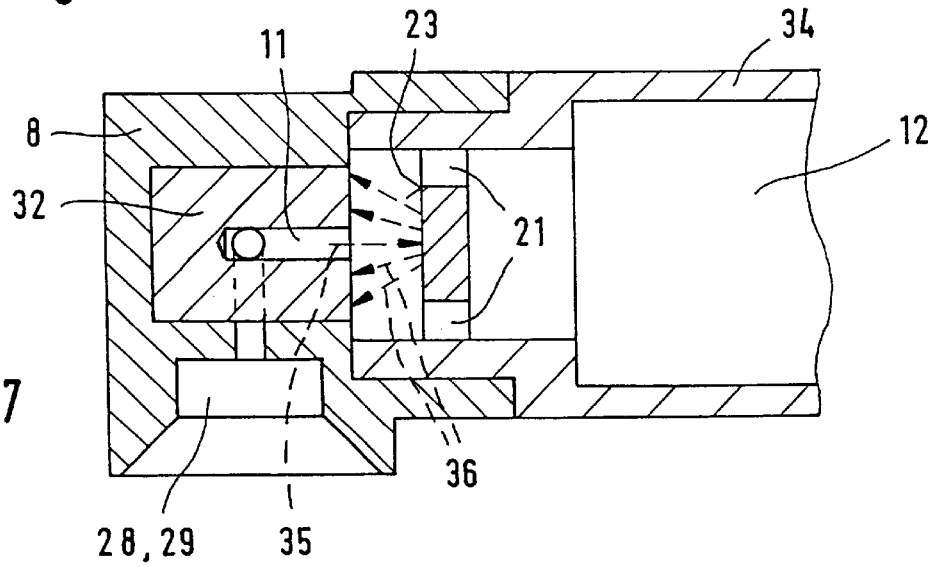
Figure 8:
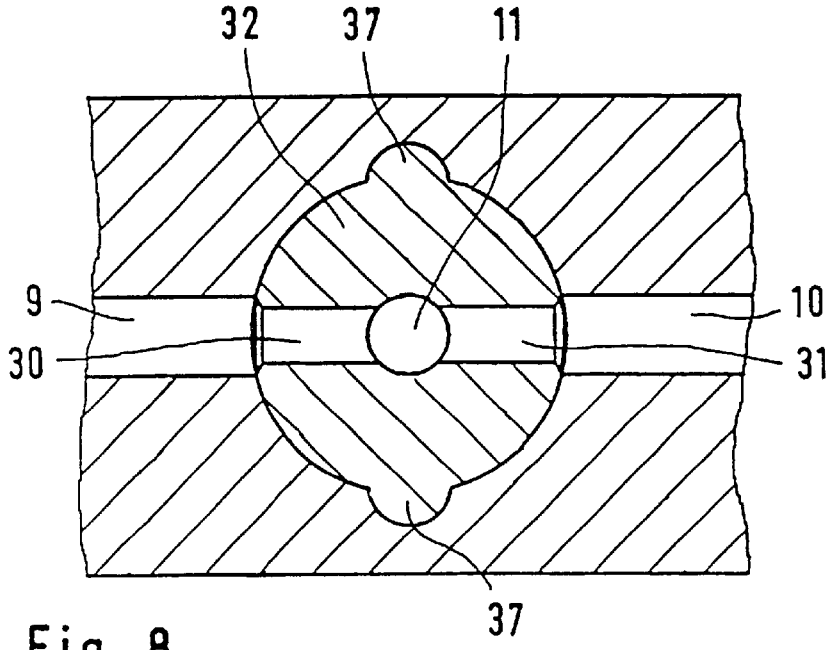
Figure 9:
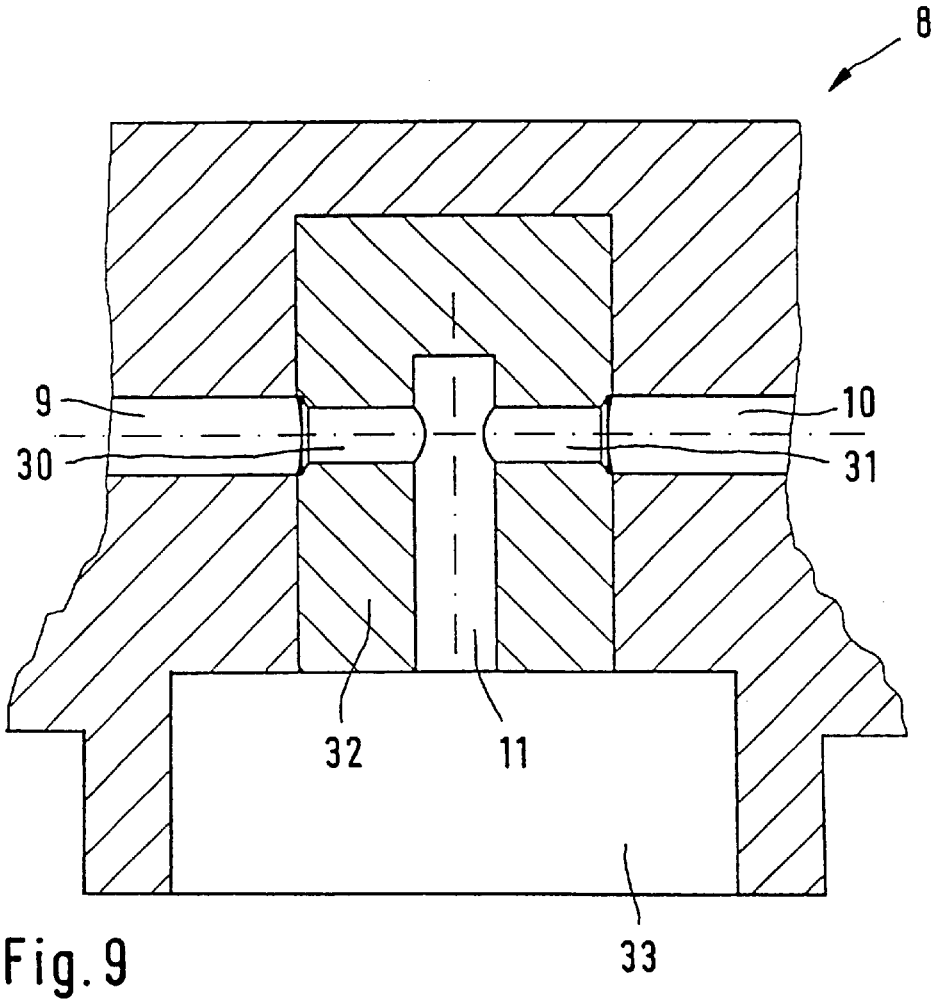
Figure 10:
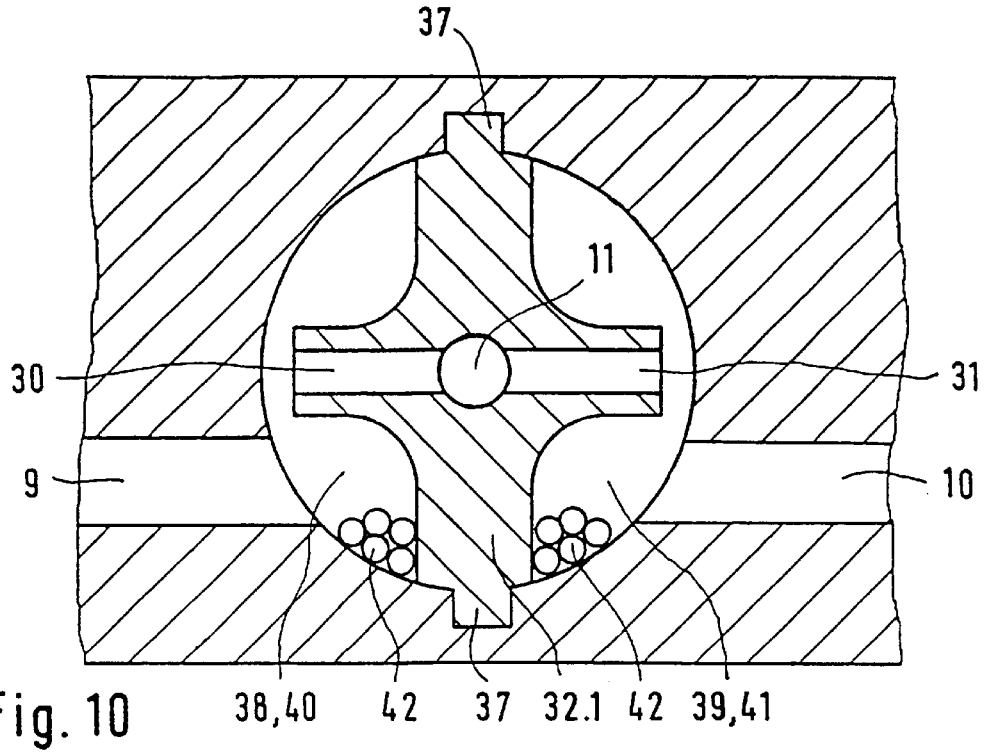
Figure 11:
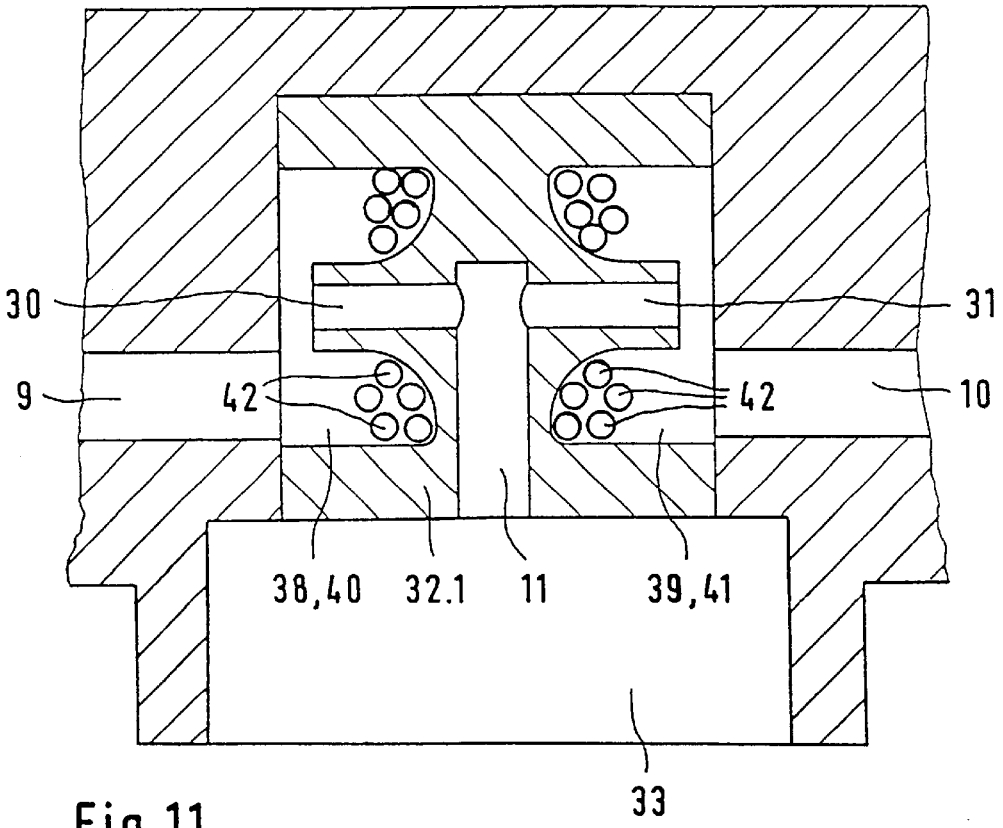
Figure 13:
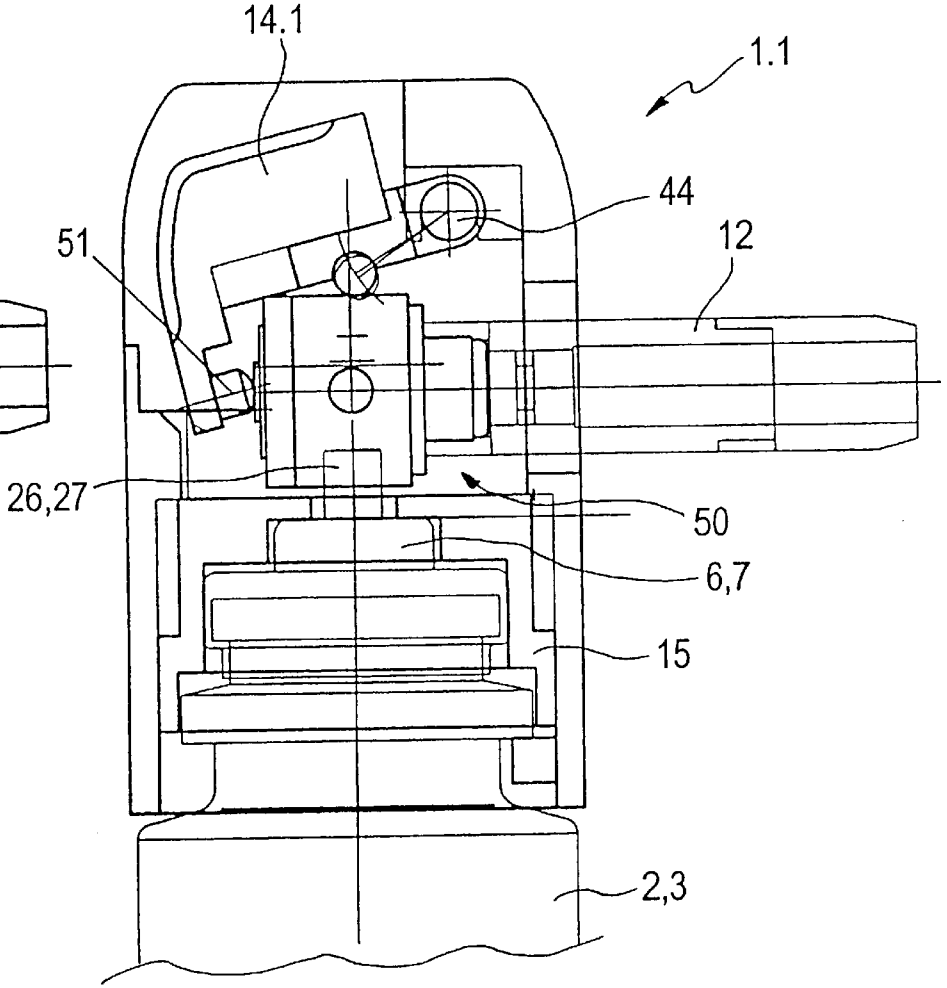
Figure 12:
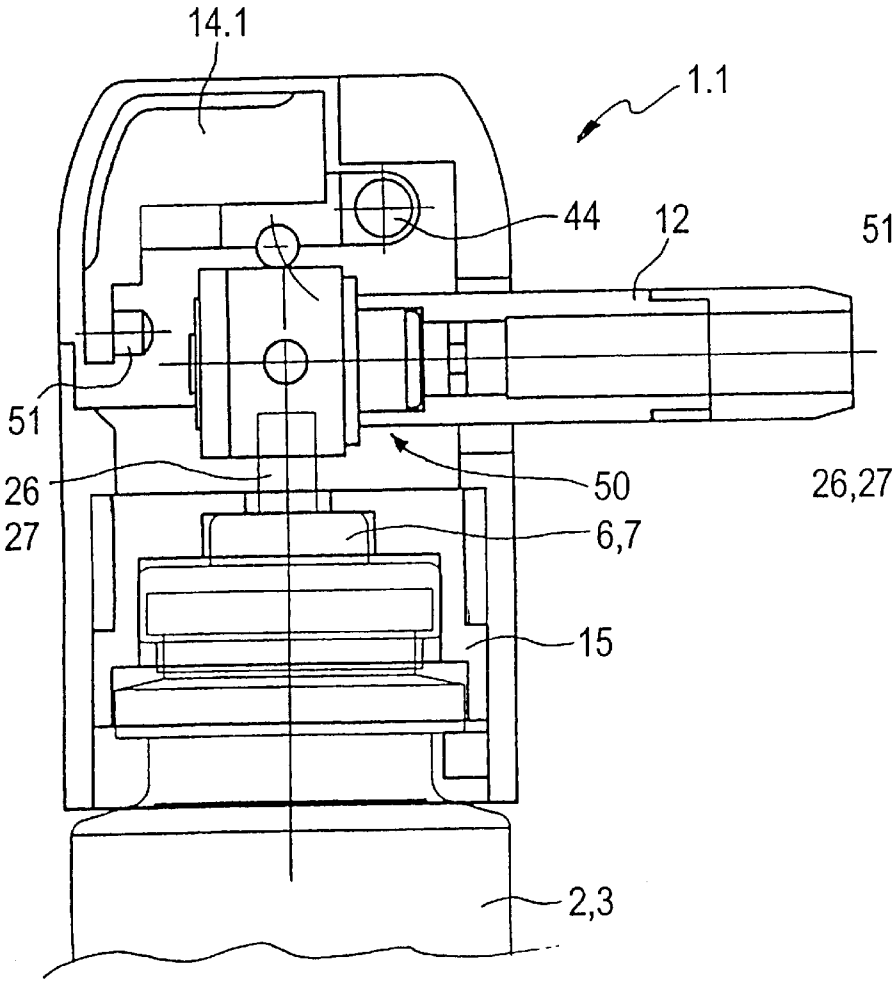

Shown are:

FIG. 1, in a side view, an upper part of a compressed gas container apparatus in a first exemplary embodiment;

FIG. 2, in a further side view, the apparatus of FIG. 1;

FIG. 3, in a sectional view along the line III—III (FIG. 4), a connecting part;

FIG. 4, in a plan view, the connecting part of FIG. 3;

FIG. 5, in a sectional side view along the line V—V (FIG. 4), the connecting part;

FIG. 6, in a sectional side view, a dispenser part;

FIG. 7, in an enlarged view, the connecting part connected to the dispenser part;

FIGS. 8 and 9, in an enlarged detail, the connecting part of FIGS. 3 and 4;

FIGS. 10 and 11, in a detail view corresponding to FIGS. 8 and 9, a connecting part with dam chambers;

FIGS. 12–15, a second exemplary embodiment in various views;

FIGS. 16–21, a third exemplary embodiment in various views; and

FIGS. 22–30, a fourth exemplary embodiment in various views.

FIGS. 1–11 show a first exemplary embodiment of a compressed gas container apparatus 1. FIG. 1 shows a compressed gas container apparatus 1 with two, or selectively more, compressed gas containers 2, 3 disposed side by side, each for one foamable liquid product 4, 5 that contains a liquidfied propellant gas. Both compressed gas containers 2, 3 are provided each with one valve 6, 7, and both valves 6, 7 are actuatable in common by a top fitting 8. Each valve 6, 7 is provided through the top fitting 8 with a respective connecting conduit 9, 10, and the connecting conduits 9, 10 discharge into a mixing chamber 11. The mixing chamber 11 is adjoined by an expansion conduit 12, which on its end has a foam dispensing opening 13. The connecting conduits 9, 10 and the mixing chamber 11 have such small cross-sectional areas that when a product is dispensed, the products 4, 5 flowing through the connecting conduits 9, 10 and the mixing chamber 11 remain in a liquid phase. The connecting conduits 9, 10 discharging into the mixing chamber 11 are oriented approximately at an angle of 180° from one another, and as a result good mixing of both products 4, 5 takes place in the liquid phase in the mixing chamber 11. Approximately 0.6 mm has proved to be an optimal diameter for the connecting conduits 9, 10, as has a diameter of approximately 0.4 to 1.2 mm, preferably 0.6 mm, for the mixing chamber 11. For simultaneous actuation of both valves 6, 7 by way of the top fitting 8, a pushbutton 14 is provided. A connecting part 15 holds the compressed gas containers 2, 3 firmly together.

Further details can be seen in FIG. 2. For actuating the valves 6, 7, the pushbutton 16 is provided with a joint 16, and as a result, for instance by means of two protrusions 17 or rollers 18, the top fitting 8 can be moved axially downward. A centrally disposed impact part 20, 20.1 that is oriented toward the mixing chamber 11 is disposed in the beginning region 19 of the expansion conduit 12. As a result, further mixing and incipient foaming of the two liquid products 4, 5 take place in this beginning region 19. A further flow of the product mixture through the mixing chamber 11 takes place via radially disposed openings 21 and then flows through the foam dispensing opening 13 to be dispensed. The impact part 20 is advantageously embodied as a disk 22, advantageously in concave form and/or with a relatively raw surface 23, resulting in further mixing of the two products 4, 5. For adjusting the expansion conduit 12, this conduit is provided with a bellows region 24, for example, as a result of which a transport position (indicated by reference numeral 25) can selectively be provided. Each of the valves 6, 7 has one axially actuatable valve peg 26, 27, which are each received by a respective valve peg receptacle 28, 29.

The mixing chamber 11 is provided with mixing chamber orifices 30, 31 in the form of an insert part 32 in to the top fitting 8, as is also seen from FIGS. 3, 4, 5 and 7. As seen especially well from FIGS. 4, 5 and 6, the mixing conduit 11 is provided on its end with a tubular receptacle 33 for receiving a dispensing tube 34 that forms the expansion conduit 12.

In FIG. 6, the dispensing tube 34 is shown as an individual part, which has the impact part 20 or the disk 22, around which a plurality of radial openings 21 are disposed.

FIG. 7 in an enlargement shows the top fitting 8 communicating with the dispensing tube 34, and from this drawing the function of the impact part 20 or disk 22 can be seen more clearly, as indicated by the streams shown in dashed lines. The already-mixed main stream 35 from the mixing chamber thus directly, centrally, strikes the impact part 20 (disk 22), and is then sprayed in a broad scattering pattern 36 from the (raw) surface 23 of the impact part 20 (disk 22), and as a result the degree of mixing is increased further. Downstream of the scattering 36, the mixture flows through the radial openings 21, and then foams up in the expansion conduit 12.

Further details of the insert part 32 can be seen from FIGS. 8 and 9. Depending on the cross-sectional area of the mixing chamber orifices 30, 31, a mixture ratio of the liquid products 4, 5 and an adaptation to various viscosities can be predetermined. For a predetermined axial position of the insert part 32 in the top fitting 8, a groove guide 37 is provided. Depending on the predetermined angle of the axial position, both mixing chamber orifices 30, 31 can be changed in their cross section.

A variant of an insert part 32 is shown in FIGS. 10 and 11 in the form of the insert part 32.1. Here, each of the connecting conduits 9, 10 are interrupted by a dam chamber 38, 39; the dam chambers 38, 39 are each embodied as an annular chamber 40, 41 and communicate with the mixing chamber orifices 30, 31. As a result of the function of a retention filter, solid product components (solid particles 42) can accumulate in the dam chambers 38, 39, thus preventing a functional hindrance from clogging. The dam chambers 38, 39 are formed by corresponding recesses in the insert part 32, 31. Once again suitable groove guides 37 can be provided.

A first refinement of the first exemplary embodiment of FIGS. 1–11 is shown as a second exemplary embodiment of a compressed gas container apparatus 1.1 in FIGS. 12–15. The special feature here is that in addition to the first exemplary embodiment, a further valve 50 upstream of the expansion conduit 12 is provided, which does not open until the two valves 6, 7 of the compressed gas containers 2, 3 have already opened. It is in fact not possible to preclude that if the pushbutton 14 is actuated very slowly, only a single product 4, 5 will flow for a certain time out of the foam dispensing opening 13, since for a certain period of time only a single valve 6, 7 is open because of opening travel tolerances of the valves 6, 7. The result is that an unmixed foam is improperly dispensed; this is provided by the third valve 50 as an actual product dispensing valve 50 when both valves 6, 7 are open, because the product dispensing valve 50 does not open until it is certain that the valves 6, 7 on the pressure containers 2, 3 have already opened. This is accomplished by providing that, by actuation of the pushbutton 14.1, the two valves 6, 7 are opened first, and only after that is the product dispensing valve 50 opened. This happened because an additional bolt 51 on the pushbutton 14.1 with delayed travel moves a tappet 52, which presses a spring-loaded (by spring 55) opening plate 53 open, and as a result the mixture of the liquid products 4, 5 then flows through the metering bore 54 into the expansion conduit 12 where it foams up as an optimally mixed foam. Once the pushbutton 14 is released, the opening plate 53 first closes, and after that the valves 6, 7 of the two compressed gas containers 2, 3 close. The actuating travel paths of the pushbutton 14, valves 2, 3 and product dispensing valve 50 are adapted to one another in such a way that at any time, only a foam mixture can be removed from the foam dispensing opening 13. The bolt 52 is sealed off in fluid-tight fashion from the outside by a sealing disk 56.

Figure 14:
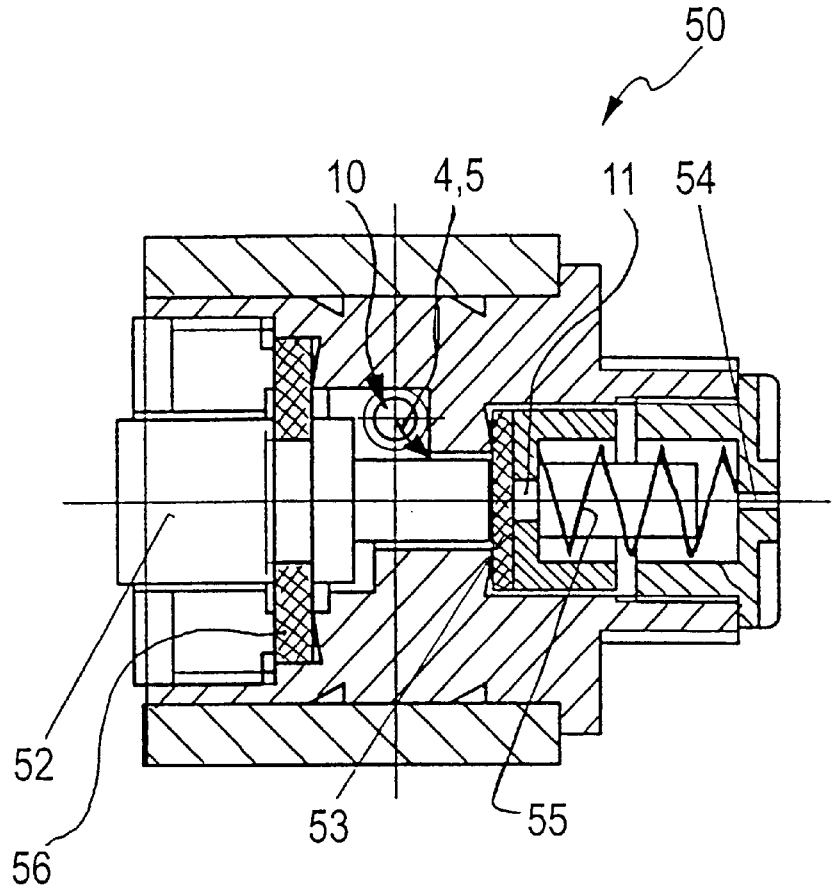
Figure 15:
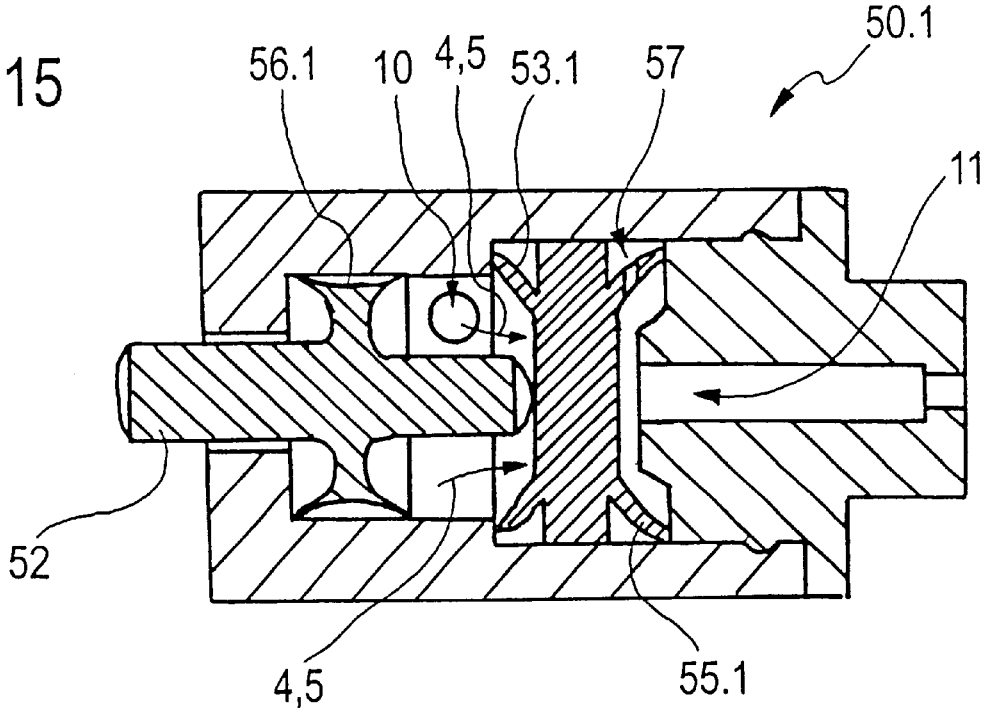

The product dispensing valve 50 shown in FIG. 14 is constructed more from a functional standpoint; the product dispensing valve 50.1 shown in FIG. 15 is optimized for manufacture and also comprises fewer individual parts. For instance, the sealing disk 55 and the bolt 52 are combined into one part. The same is true for the opening plate 53 and the spring 55.1, which has at least one flow opening 57.

Figure 16:
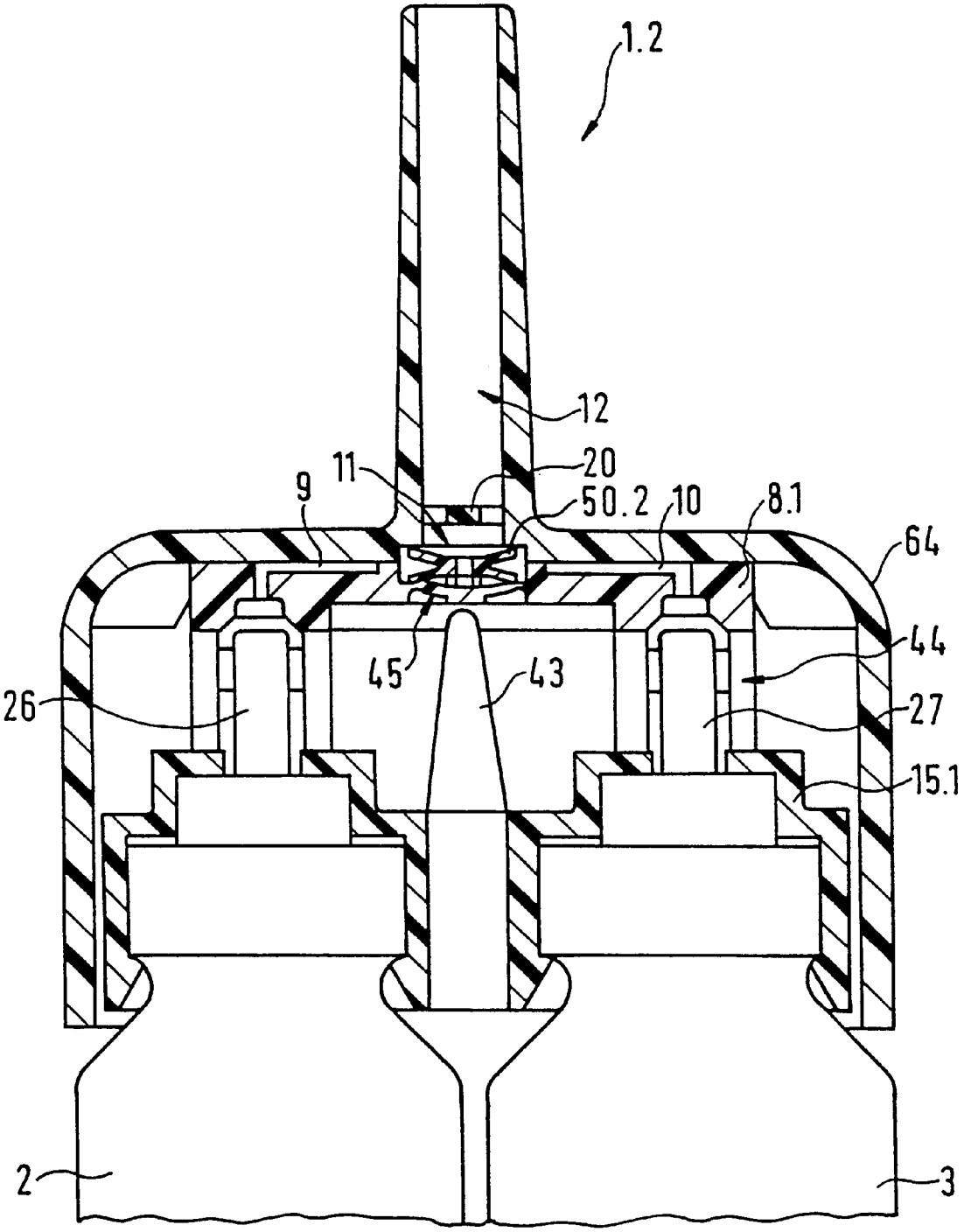

In FIG. 16, a third exemplary embodiment of a compressed gas container apparatus 1.2 is shown. Here, a top fitting 8.1, a cap 64, a product dispensing valve 50.2, and an actuating pushbutton 14.1 form an economical structural unit, and the top fitting 8.1 and the cap 64 are solidly joined to one another. By manual actuation of the pushbutton 14.1 (FIG. 17), first the two valves 6, 7 are opened, and after that, by means of a fingerlike protrusion 43 on the connecting part 15.1, a product dispensing valve 50.2 is additionally activated. As a result, mixed foam is reliably dispensed.

Figure 17:
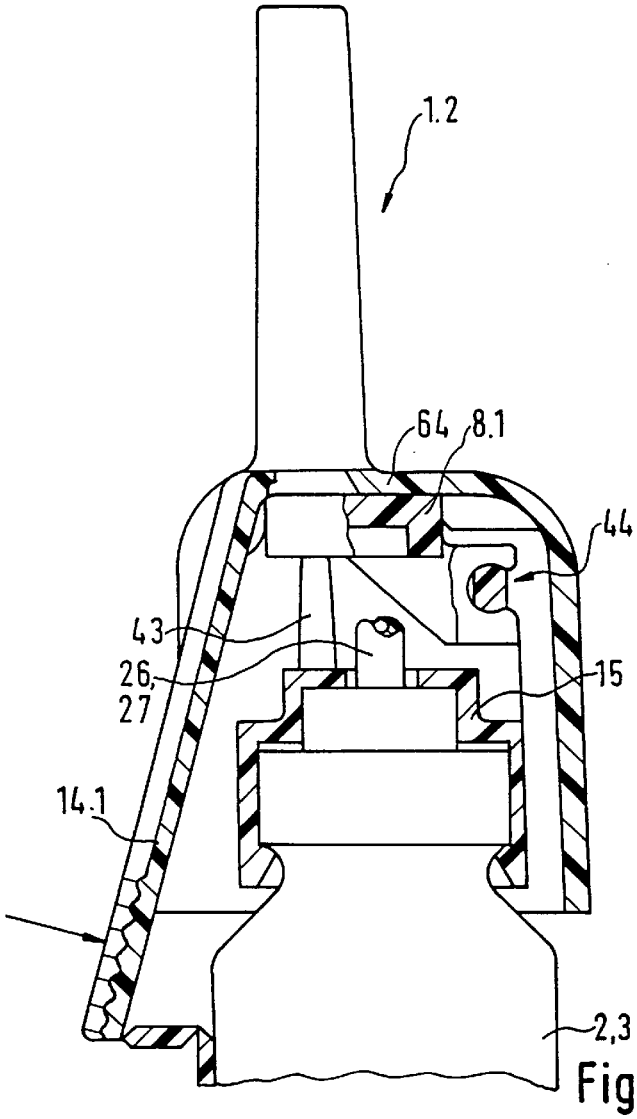

FIG. 17, in a side view of FIG. 16, shows a swivel connection 44 between the connecting part 15.1 and the cap 64, and as a result, the valves 6, 7 and the product dispensing valve 50.2 can be actuated via the pushbutton 14.1.

Figure 18:
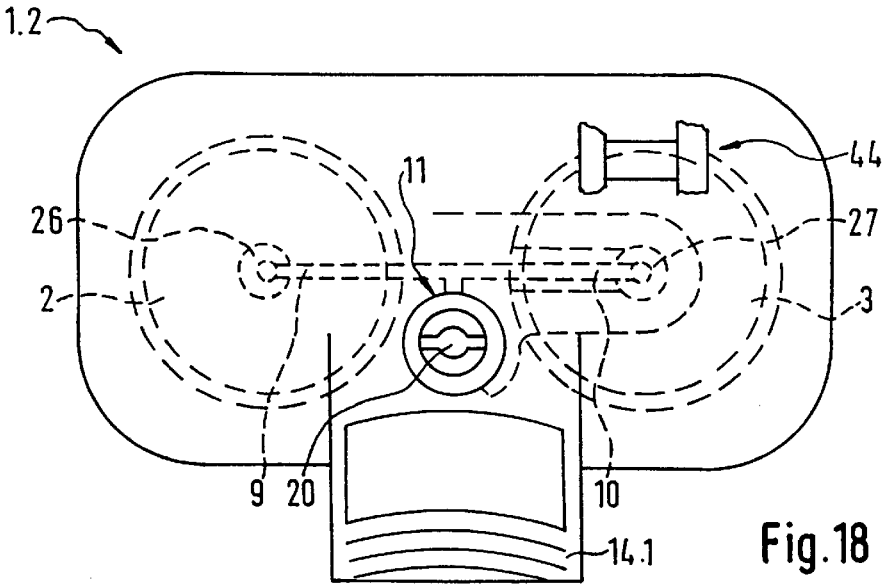

Further details can be seen from the plan view in FIG. 18.

Figure 19:
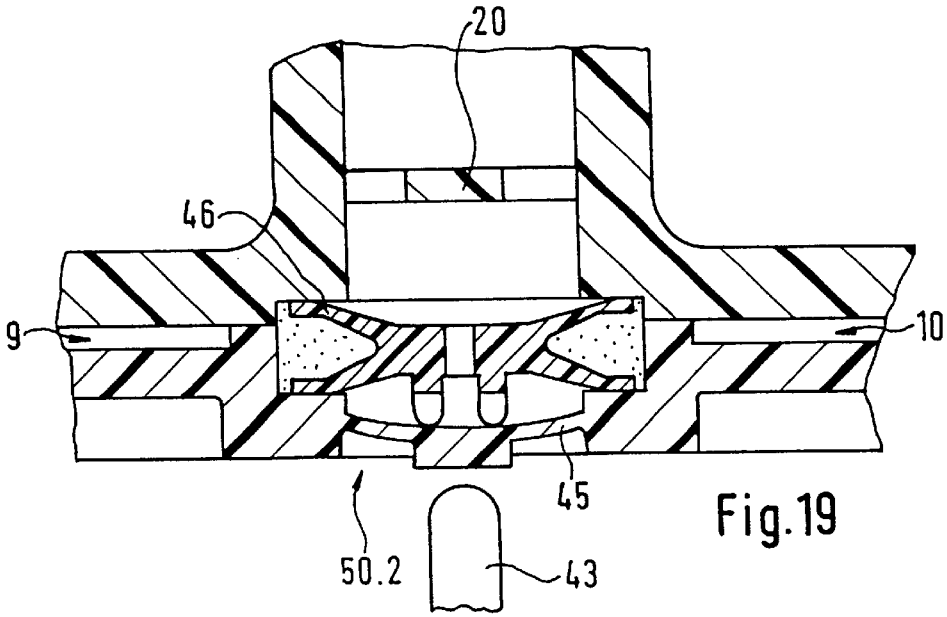
Figure 20:
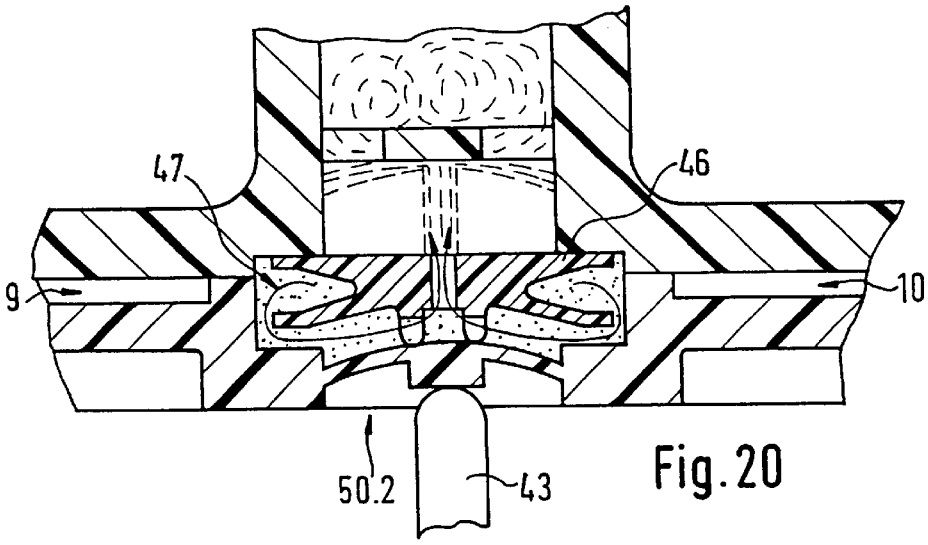
Figure 21:
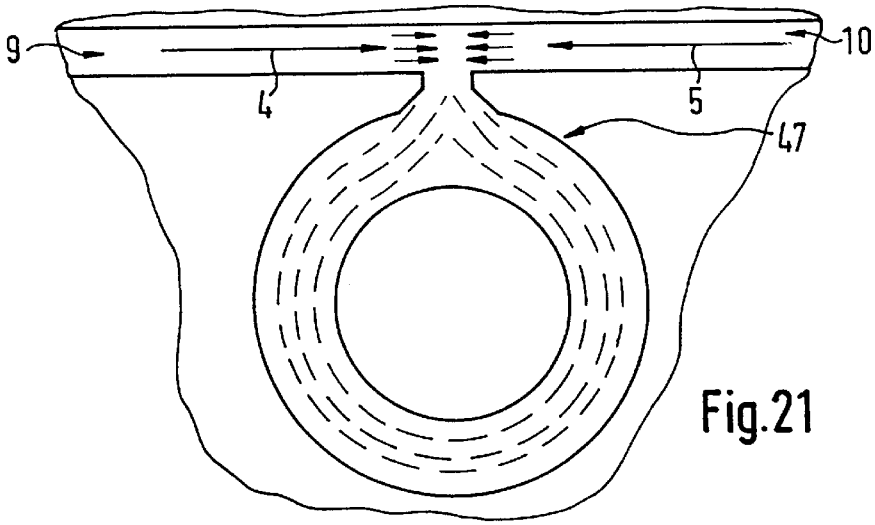

FIGS. 19–21 show the product dispensing valve 50.2 of FIGS. 16–18 in an enlarged detail view. In FIG. 19, the product dispensing valve 50.2 is shown in the closed state. FIG. 20 shows the product dispensing valve 50.2 in the open state, which is achieved in that the fingerlike protrusion 43 presses a sealing cup 45 axially into the valve 50.2, thereby opening a resilient valve disk 46. The chamber 47 that is occupied by the valve disk 46 at the same time forms a mixing chamber 11.

A plan view on the mixing chamber 11 with the two connecting conduits 9, 10, but without the valve disk 46, is shown in FIG. 21.

A fourth exemplary embodiment of a compressed gas container apparatus 1.2 is shown in FIGS. 22–30. The two compressed gas containers 2, 3 are each provided with one valve 6.1, 7.1, which have an opening stroke of approximately 0.2 mm and preferably 0.1 mm. As a result, lopsided, uneven manual actuation of the valves 6.1, 7.1 by the pushbutton 14 is practically precluded, which thus also precludes an unmixed foam component comprising only one of the products 4, 5 from being dispensed. By limiting the actuating stroke of the valves 6.1, 7.1 to approximately 0.5 mm, a short actuation travel of the pushbutton 14.1 is also achieved. As the mixing chamber 11, a rotational turbulence mixing chamber 6.1 with an impact part 20.1 is provided. The rotational turbulence mixing chamber 6.1 brings about an extreme mixing of the two liquid products 4, 5, and it is dimensioned such that the two liquid products 4, 5 along with the liquidfied propellant gas component do not change over into a foam phase until they flow into the expansion conduit 12, and at the end of the expansion conduit 12, the completely foamed products 4, 5 can be removed from the foam dispensing opening 13. A riblike impact part 20.1 brings about further mixing of the products 4, 5. The top fitting 8.1 comprises two mirror-symmetrical halves 62, 63, which in the joined-together (welded) state have, all in one piece, the valve peg receptacles 28, 29, the connecting conduits 9, 10, the mixing chamber 11 or rotational turbulence mixing chamber 61, the impact part 20.1, and the expansion conduit 12. By manual pressure on the pushbutton 14.1, which is received by a cap 64, the top fitting 8.1 is pressed downward, and the valves 6.1, 7.1 are thus activated. The lower ends of the compressed gas containers 2, 3 are held together on the lower end of the apparatus 1.2 by a bottom part 65.

Figure 23:
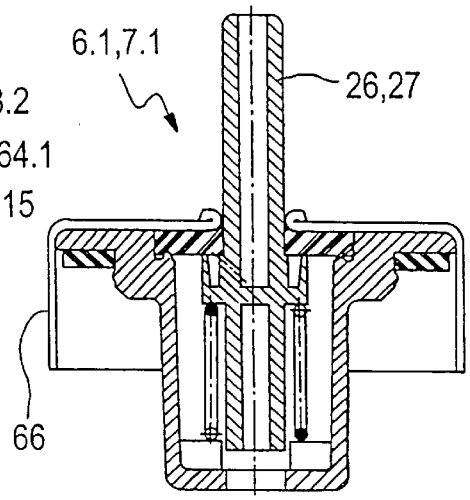

FIG. 23, in an enlarged sectional view, shows one basic example of a valve 6.1, 7.1 with a valve plate 66; this valve has an opening stroke of 0.1 to 0.2 mm and a stroke limitation of approximately 5 mm. The valves 6.1, 7.1 have a relatively low tolerance in terms of the opening travel, which assures fairly identical mixing proportions of the components (products 4, 5).

Figure 22:
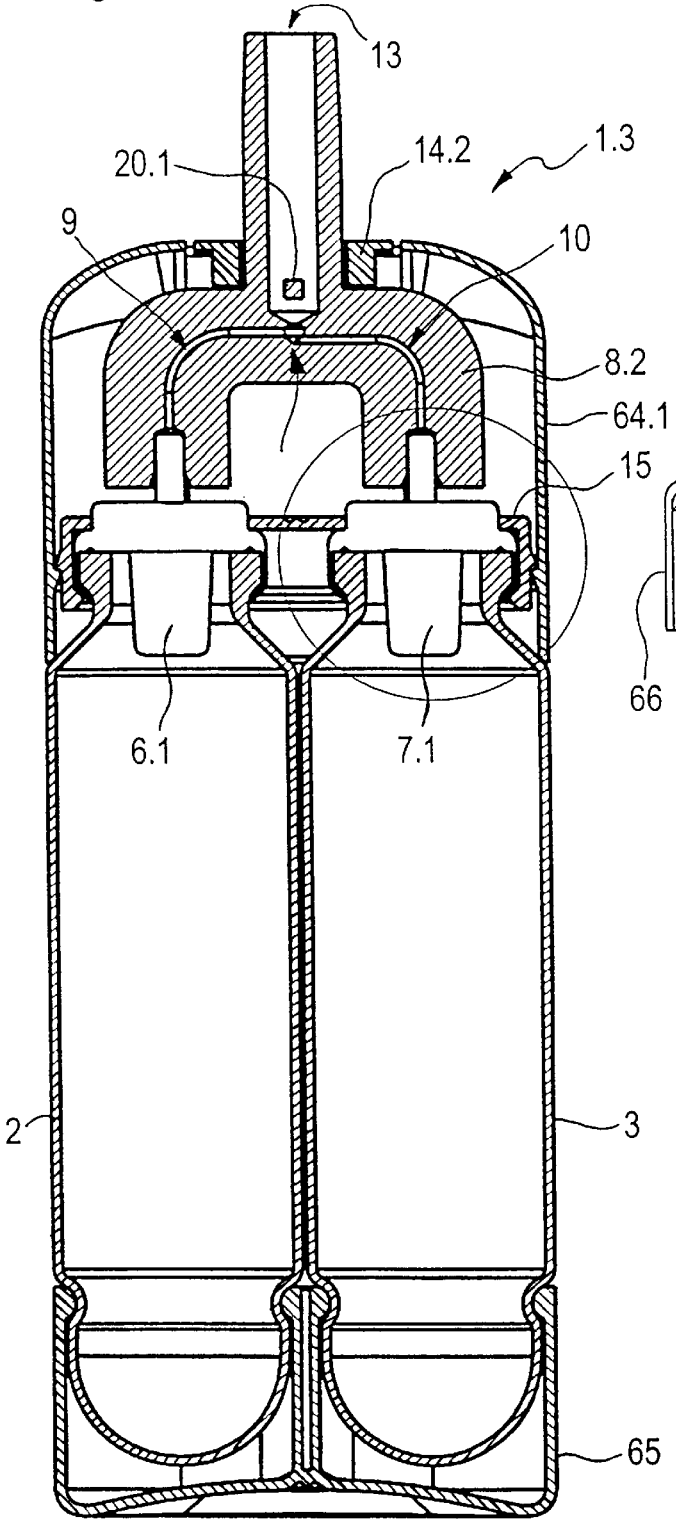
Figure 24:
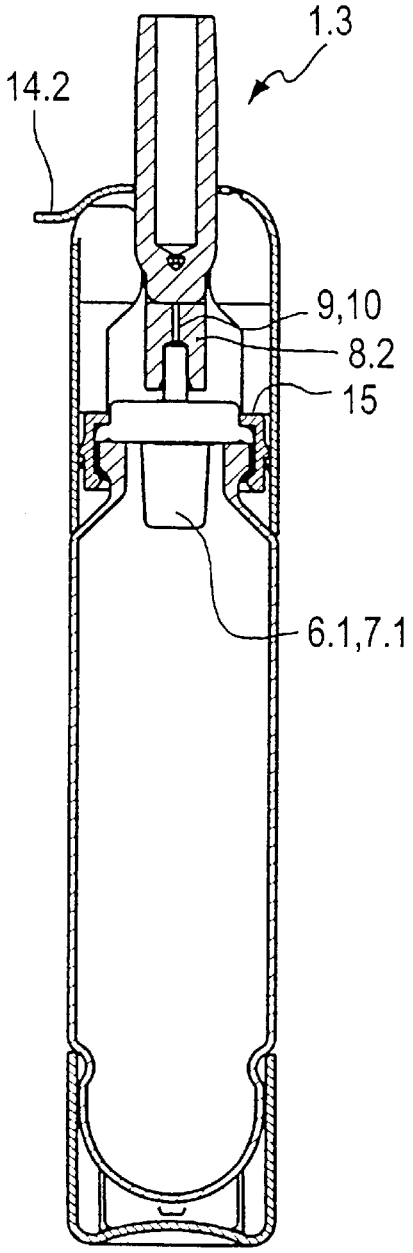

FIG. 24 shows a side view of the compressed gas container apparatus 1.2 of FIG. 22.

Figure 25:
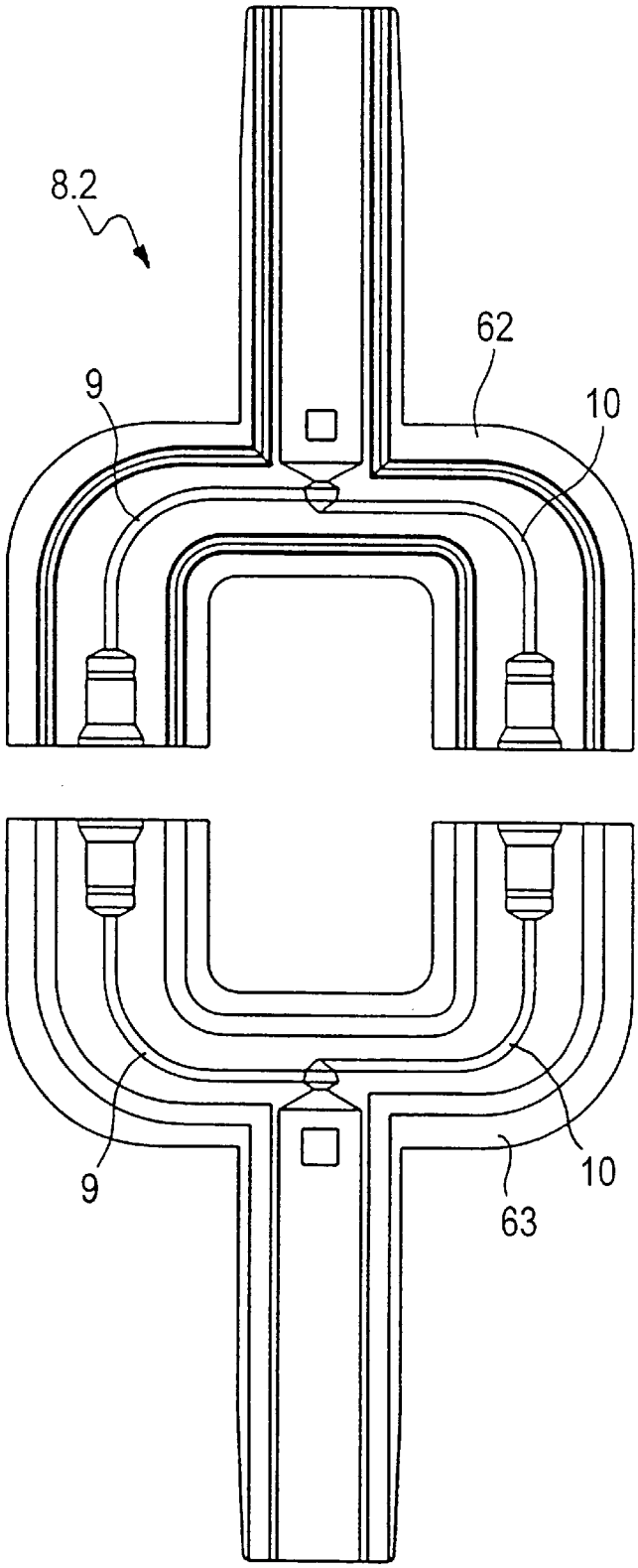

FIG. 25, in an enlarged plan view, shows a top fitting 8.1, made of two mirror-symmetrical halves, which in the joined-together state (joined for instance by ultrasonic welding) has the valve peg receptacles 28, 29, the connecting conduits 9, 10, the mixing chamber 11, the impact part 20.1, and the expansion conduit 12.

Figure 26:
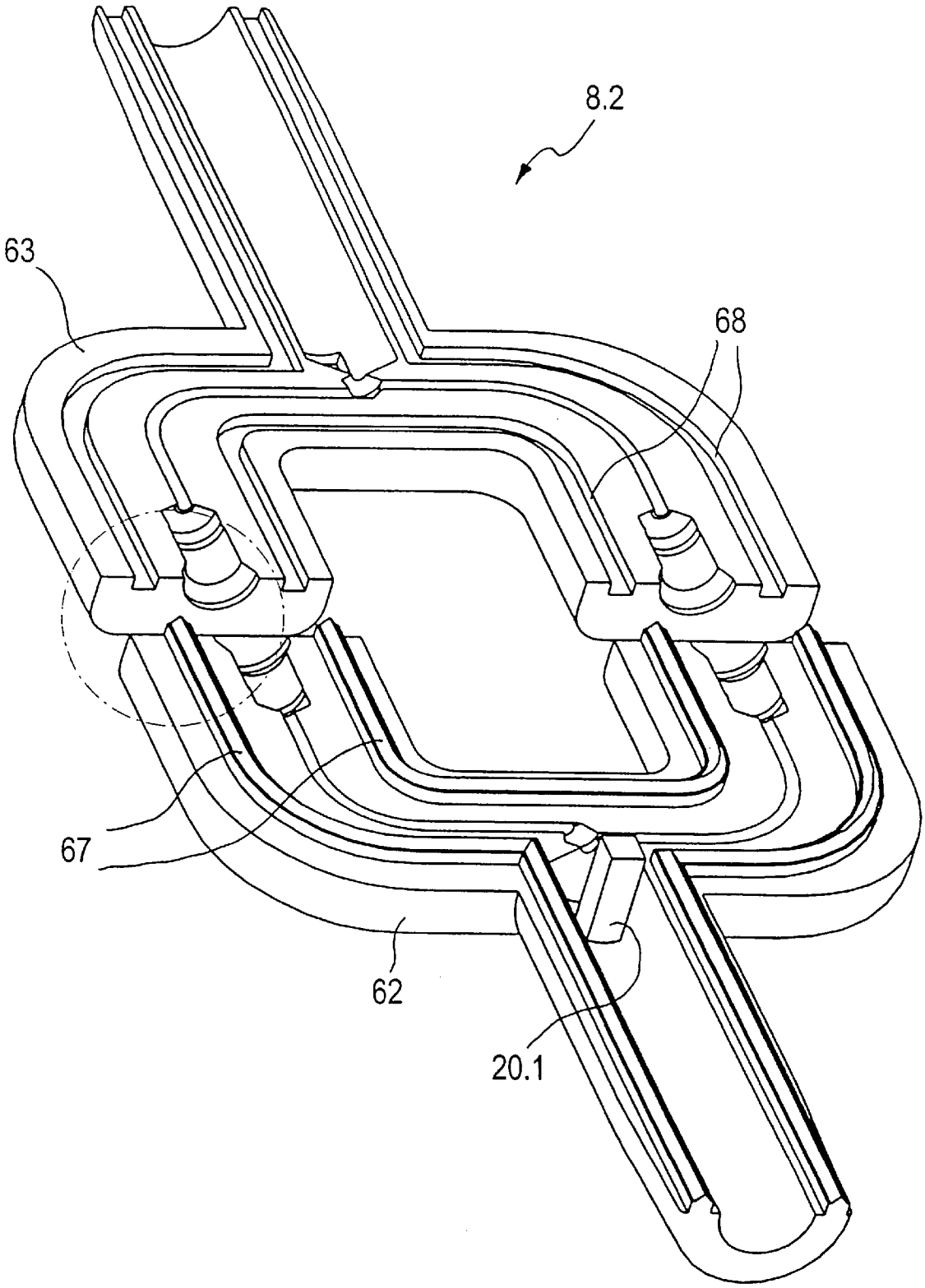
Figure 27:
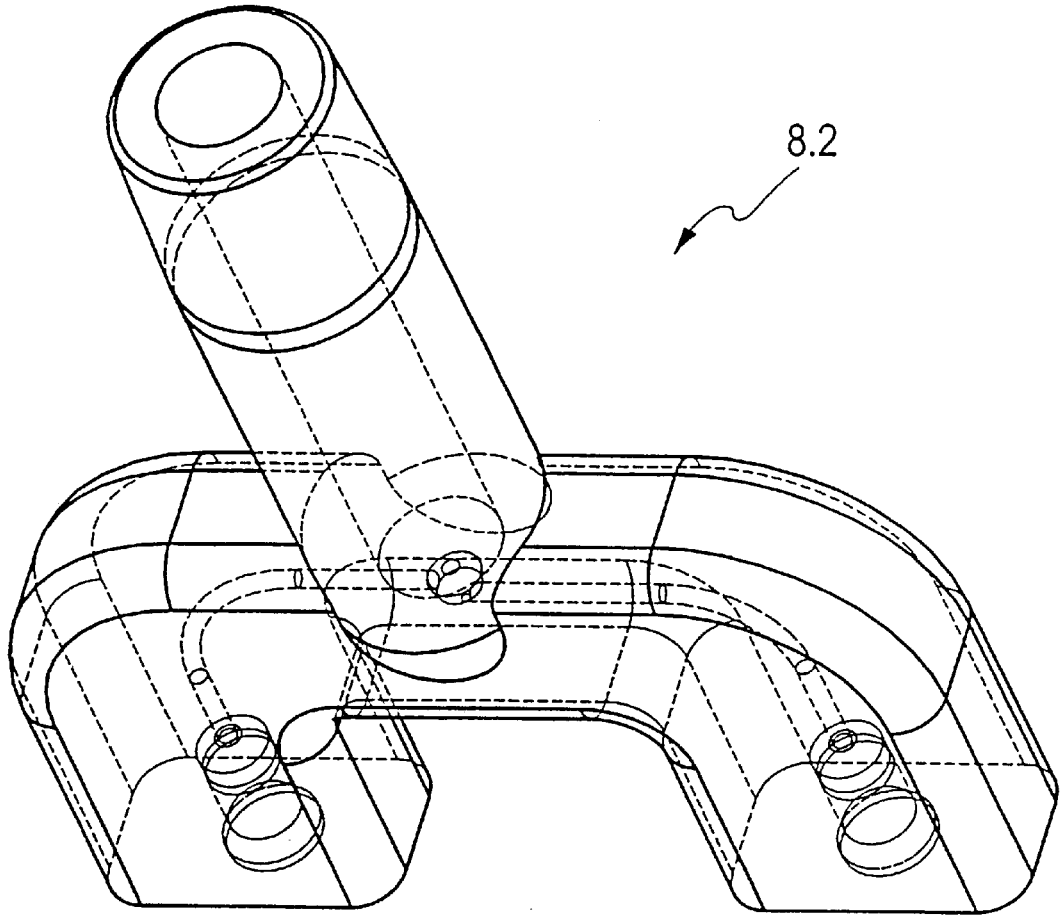
Figure 28:
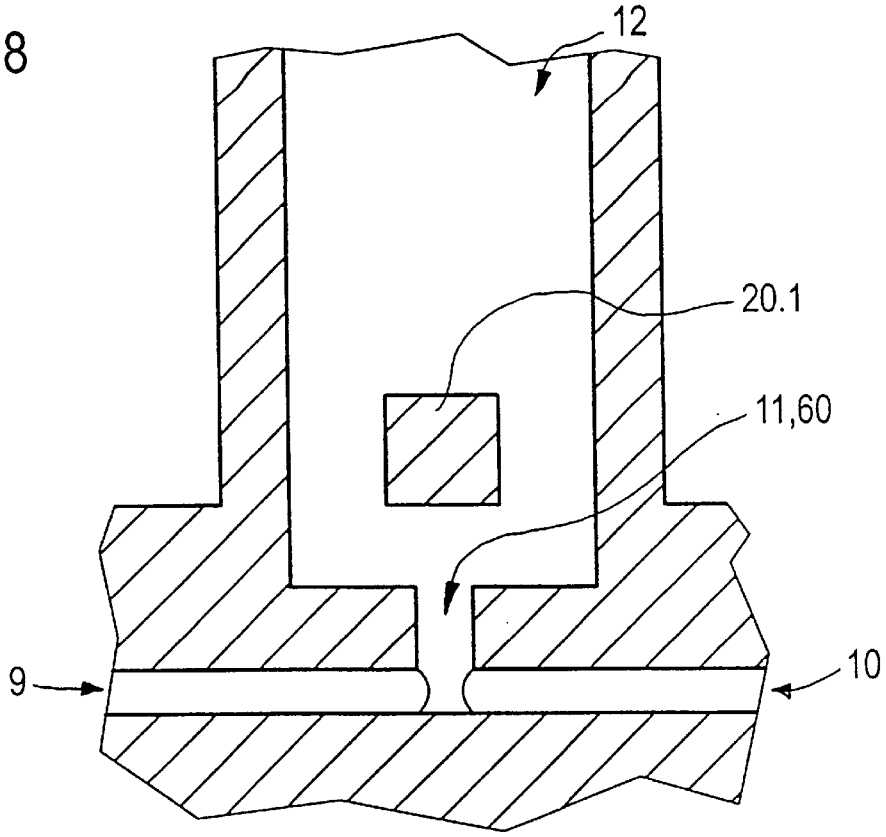

In FIG. 26, for the sake of better illustration, the two halves 62, 63 of the top fitting 8.1 of FIG. 25 are shown in perspective. The first half 62 is provided with ribs 67, which are joined together in pressureproof fashion with corresponding grooves 68 of the second half 63, for instance by an ultrasonic welding process. FIG. 27 shows this connection of the two halves 62, 63 in greater detail and in perspective in the form of a one-piece top fitting 8.1. FIG. 28, in an enlarged detail, shows a mixing chamber 11 embodied as a turbulence mixing chamber 60, in which the connecting conduits 9, 10 are oriented counter to one another. The mixed product 4, 5 flows from the turbulence mixing chamber 60 into the expansion conduit 12 and is further mixed by the impact part 20.1 and then changes over into the form of a foam.

Figure 29:
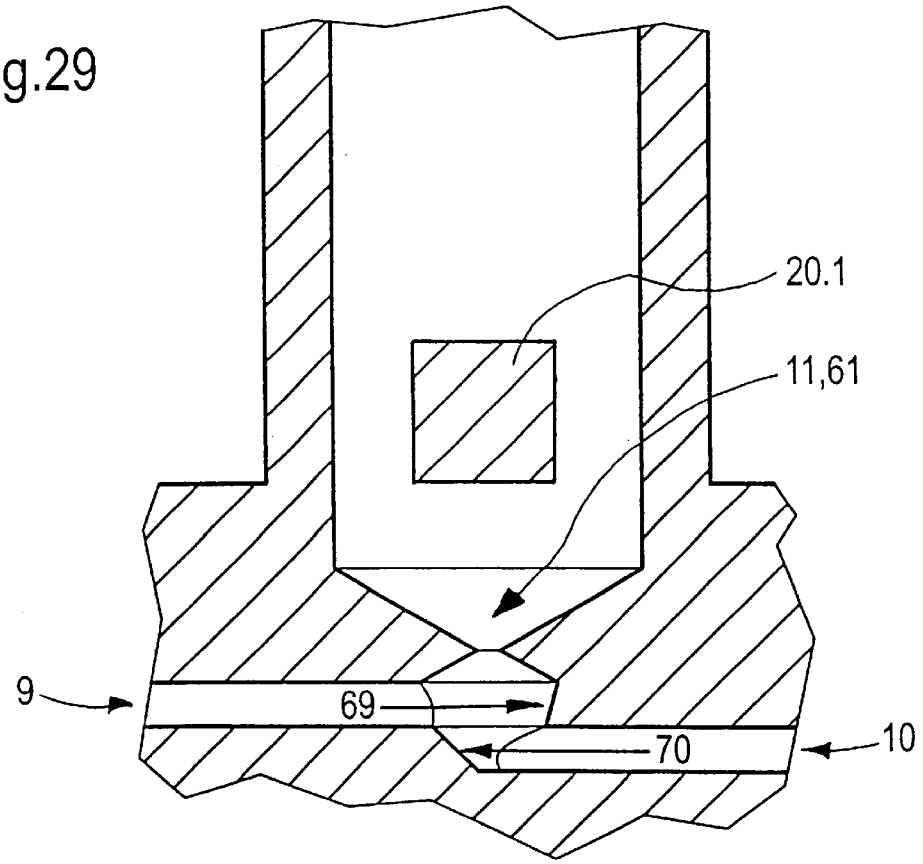

FIG. 29, in an enlarged detail, shows a mixing chamber 11 embodied as a rotational mixing chamber 61, in which the connecting conduits 9, 10 flow in different planes into the rotational mixing chamber 61, thus achieves still-optimal mixing of the products 4, 5, because with this embodiment, additional mixing impact faces 69, 70 are created.

Figure 30:
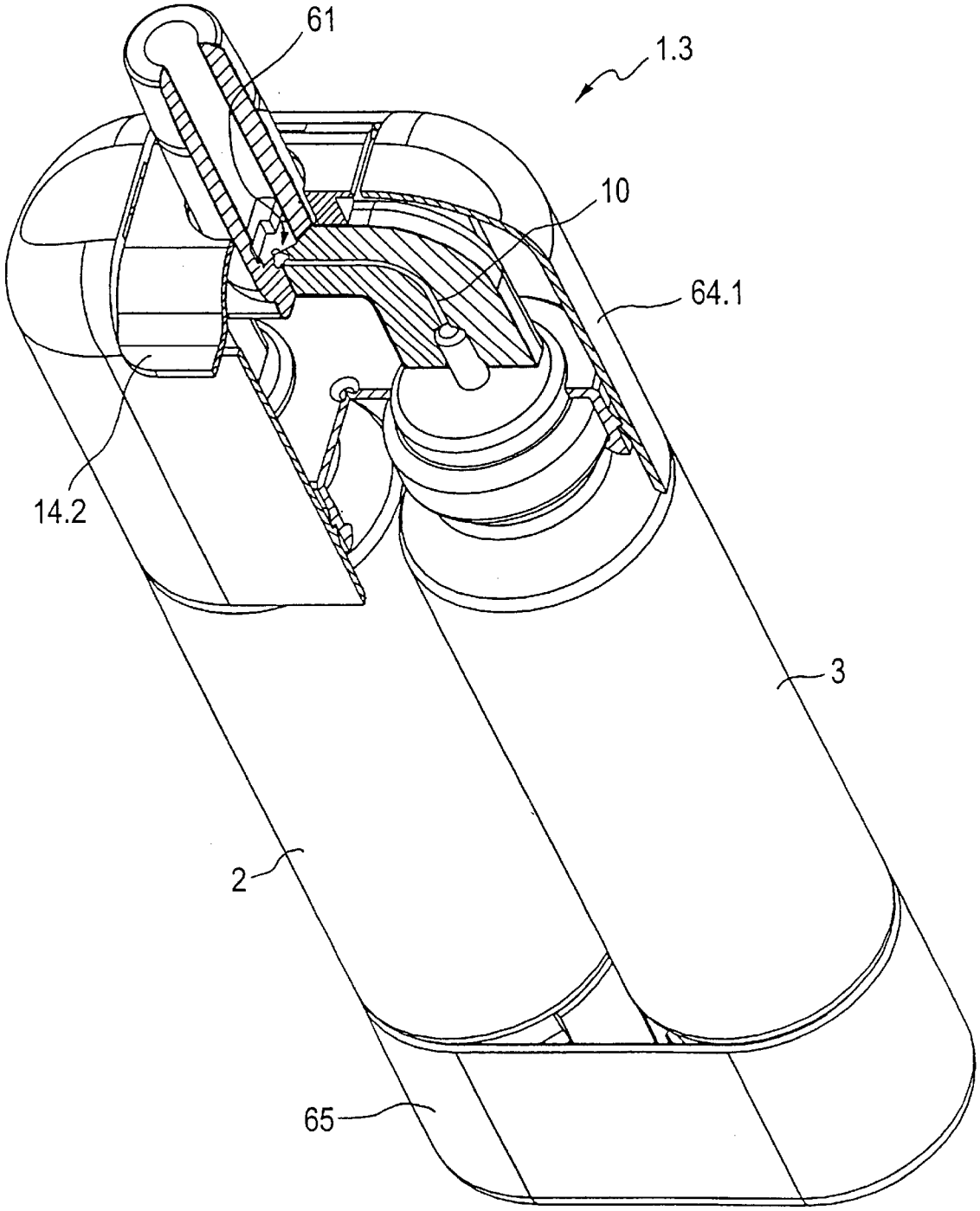

FIG. 30 shows the complete compressed gas container apparatus 1.2 in a perspective view, with various details for the sake of better illustration.

List of Reference Numerals

| | |
|---|---|
| 1, 1.1–1.3 | Compressed gas container apparatus |
| 2, 3 | Compressed gas container |
| 4, 5 | Liquid product |
| 6, 7; 6.1, 7.1 | Valve |
| 8, 8.1, 8.2 | Top fitting |
| 9, 10 | Connecting conduit |
| 11, 11.1, 11.2 | Mixing chamber |
| 12 | Expansion conduit |
| 13 | Foam dispensing opening |
| 14 | Pushbutton |
| 15 | connecting part |
| 16 | Joint |
| 17 | Protrusion |
| 18 | Roller |
| 19 | Beginning region |
| 20, 20.1 | Impact part |
| 21 | Radial openings |
| 22 | Disk |
| 23 | Raw surface |
| 24 | Bellows region |
| 25 | Transport position |
| 26, 27 | Valve peg |
| 28, 29 | Valve peg receptacle |
| 30, 31 | Mixing conduit orifices |
| 32, 32.1 | Insert part |
| 33 | Tubular receptacle |
| 34 | dispensing tube |
| 35 | Main stream |
| 36 | Scattering |
| 37 | Groove guide |
| 38, 39 | Dam chamber |
| 40, 41 | Annular chamber |
| 42 | Solid particles |
| 43 | Protrusion |
| 44 | Swivel connection |
| 45 | Sealing cup |
| 46 | Valve disk |
| 50 | product dispensing valve |
| 51 | Bolt |
| 52 | Tappet |
| 53 | Orifice plate |
| 54 | Metering bore |
| 55 | Spring |
| 56 | Sealing disk |
| 57 | Flow opening |
| 60 | Turbulence mixing chamber |
| 61 | Rotational turbulence mixing chamber |
| 62 | First half-part |
| 63 | Second half-part |
| 64 | Cap |
| 65 | Bottom part |
| 66 | Valve plate |
| 67 | Rib |
| 68 | Groove |
| 69 | Mixing impact face |
| 70 | Mixing impact face |

What is claimed is:

1. A compressed gas container apparatus (1), having at least two compressed gas containers (2, 3), disposed side by side, each for one foamable liquid product (4, 5) which contains a liquefied propellant gas, wherein both compressed gas containers (2, 3) are each provided with a valve (6, 7; 6.1, 7.1), both valves (6, 7; 6.1, 7.1) are actuatable in common by a top fitting (8, 8.1), and each valve (6, 7; 6.1, 7.1) is provided through the top fitting (8, 8.1) with a connecting conduit (9, 10), the connecting conduits (9, 10) discharge into a mixing chamber (11), and an expansion conduit (12) adjoins the mixing chamber (11) and on its end has a foam dispensing opening (13), characterized in that the connecting conduits (9, 10) and the mixing chamber (11) have such small cross-sectional areas that when a product is dispensed, the products (4, 5) flowing through the connecting conduits (9, 10) and the mixing chamber (11) remain in a liquid phase.

2. The apparatus of claim 1, characterized in that connecting conduits (9, 10) discharging into the mixing chamber (11) are oriented at an angle of approximately 180° from one another.

3. The apparatus of claim 1, characterized in that the connecting conduits (9, 10) have a diameter of approximately 0.6 mm.

4. The apparatus of claim 1, characterized in that the mixing chamber (11) has a diameter of from 0.4 to 1.2 mm, and preferably approximately 0.6 mm.

5. The apparatus of claim 1, characterized in that a centrally disposed impact part (20, 20.1) that is oriented toward the mixing chamber (11) is disposed in a beginning region (19) of the expansion conduit (12).

6. The apparatus of claim 5, characterized in that the impact part (20) is embodied as a disk (22).

7. The apparatus of claim 6, characterized in that the impact part (20) is embodied in concave form.

8. The apparatus of claim 5, characterized in that the impact part (20) is provided with a relatively raw surface (23).

9. The apparatus of claim 1, characterized in that the connecting conduits (9, 10) are each interrupted by a dam chamber (38, 39).

10. The apparatus of claim 9, characterized in that the dam chamber (38, 39) is embodied as an annular chamber (40, 41).

11. The apparatus of claim 1, characterized in that the mixing conduit (11) with mixing conduit orifices (30, 31) is provided as an insert part (32) into the top fitting (8).

12. The apparatus of claim 11, characterized in that the dam chamber (38, 39) is formed by the insert part (32.1).

13. The apparatus of claim 1, characterized in that a product dispensing valve (50), which opens by actuation of a pushbutton (14) after the opening of the valves (6, 7) is disposed between the mixing conduit (11) and the expansion conduit (12).

14. The apparatus of claim 1, characterized in that the valves (6.1, 7.1) have an opening stroke of approximately 0.2 mm, preferably 0.1 mm.

15. The apparatus of claim 14, characterized in that the valves (6.1, 7.1) have a maximum actuating stroke of approximately 0.5 mm.

16. The apparatus of claim 14, characterized in that the valves (6.1, 7.1) have a relatively low tolerance in the opening travel.

17. The apparatus of claim 1, characterized in that the mixing chamber (11) is embodied as a turbulence mixing chamber (60).

18. The apparatus of claim 1, characterized in that the mixing chamber (11) is embodied as a rotational turbulence mixing chamber (61).

19. The apparatus of claim 1, characterized in that the top fitting (8.1) comprises two mirror-symmetrical halves (62, 63) and in the assembled state has at least two valve peg receptacles (28, 29), the connecting conduits (9, 10), the mixing chamber (11), and the expansion conduit (12).

20. The apparatus of claim 1, characterized in that the products (4, 5) are intended as hair treatment products for dyeing hair.

* * * * *